US005437316A

United States Patent [19]

McPherson

[11] Patent Number: 5,437,316

[45] Date of Patent: Aug. 1, 1995

[54] METHOD AND APPARATUS FOR DRIPLESS FILLING OF CONTAINERS

[75] Inventor: Dennis D. McPherson, Wharton, Tex.

[73] Assignee: McPherson Dripless Systems Co., Inc., Missouri City, Tex.

[21] Appl. No.: 90,888

[22] Filed: Jul. 12, 1993

Related U.S. Application Data

[60] Division of Ser. No. 787,415, Nov. 4, 1991, Pat. No. 5,255,720, which is a continuation-in-part of Ser. No. 503,830, Apr. 3, 1990, abandoned.

[51] Int. Cl.[6] ..... B65B 1/04

[52] U.S. Cl. ..... 141/86; 141/87; 141/89; 141/115

[58] Field of Search ..... 141/1, 86, 87, 89, 90, 141/115, 116, 119, 120, 198

[56] References Cited

U.S. PATENT DOCUMENTS

| | | | |
|---|---|---|---|
| 3,005,473 | 10/1961 | Ring | 141/86 |
| 3,263,711 | 8/1966 | Laub | 141/301 |
| 3,324,904 | 6/1967 | Crothers | 141/86 |
| 4,749,010 | 6/1988 | Petell | 141/115 |

*Primary Examiner*—Henry J. Recla
*Assistant Examiner*—David J. Walczak
*Attorney, Agent, or Firm*—Bush, Moseley, Riddle & Jackson

[57] ABSTRACT

A method and apparatus for dripless filling of liquid material within containers wherein a filling nozzle is moved downwardly or the container is moved upwardly until its shroud engages the upper end of the container and positions its nozzle into the container. After transferring a measured volume of liquid into the container, the filling head is moved upwardly out of contact with the liquid and vacuum is applied immediately at the lower tapered tip of the dispensing nozzle to recover any drippage descending downwardly to the point of the tip. Simultaneously with its withdrawal from the container, residual liquid is wiped from the external tubular member into the container, leaving only a small quantity of residual liquid on the tapered tip which is easily recovered by the vacuum system. The recovered drippage is transferred by the vacuum system to a vacuum chamber and is then selectively transferred from the vacuum chamber to a supply chamber for subsequent filling operation.

12 Claims, 4 Drawing Sheets

METHOD AND APPARATUS FOR DRIPLESS FILLING OF CONTAINERS

This is a Divisional of U.S. patent application Ser. No. 07/787,415, now U.S. Pat. No. 5,255,720, filed Nov. 4, 1991 by Dennis D. McPherson entitled Method and Apparatus for Dripless Filling of Containers, which is a Continuation-In-Part of U.S. patent application Ser. No. 07/503,830, now abandoned, filed on Apr. 3, 1990 and entitled METHOD AND APPARATUS FOR DRIPLESS FILLING OF CONTAINERS, by the same inventor.

FIELD OF THE INVENTION

This invention relates generally to the successive filling of containers with liquid by means of container filling apparatus having multiple filling heads. More particularly this invention is directed to dripless filling heads which prevent any drippage of liquid material from the filling heads between subsequent filling cycles.

BACKGROUND OF THE INVENTION

In industries involved in the sale of liquid products, especially liquid products of low cost, it is highly desirable to achieve rapid and successive filling of containers such as bottles, cans, drums and the like with liquid material while at the same time maintaining the cost of the filling operation per container as low as possible. Although rapid container filling systems have been in use for a considerable period of time, one of the principle problems that is typically encountered is the inability to achieve rapid filling and at the same time prevent any spillage of the liquid being filled. As container filling operations are in progress, the filler heads that are employed typically accumulate a quantity of the liquid being dispensed. Obviously in some cases the liquid is quite thin and in other cases the liquid may have considerable viscosity. At the end of a container filling cycle, when the container and filling head are separated, the accumulated liquid will descend along the outside surfaces of the filling head and drip from the filling head. It is not unusual where highly productive container filling equipment is in use, to find substantial accumulation of the liquid product on the floor and equipment in the immediate vicinity of the filling operation. It is well known that in order to minimize drips of fluid from filling heads packaging companies or users of filling equipment will slow down the cycle time of the equipment in order to help compensate for drips. Slowing of the cycle time in this manner does not eliminate drips but permits a greater percentage of the drips to fall inside the containers. Obviously, slowing down the cycle time in this manner adversely affects the productivity of the container filling equipment and thereby adversely affects the potential profit of the packaging process. It is desirable, therefore, to provide container filling equipment that eliminates all drips and thereby permits the users of the equipment to achieve maximum cycling speed of the equipment to therefore increase production rates substantially.

Obviously, the loss of any of the liquid being filled becomes a commercial disadvantage not only from the standpoint of loss of the liquid material but also from the standpoint of maintenance costs for cleaning the drip or spilled liquid from the floor and equipment. Even further, the presence of liquid on the floor and equipment can subject workers to considerable hazards form the standpoint of injuries due to slipping and falling and from the standpoint of environmental contamination. Under circumstances where drippage or spillage of liquid can be prevented during rapid container filling operations, the commercial aspects of the filling operation will be materially enhanced by minimal loss of product, by savings and cleaning costs and the costs of insurance such as liability, workmen's compensation insurance, etc. Also, during container filling operations, any drippage from the filling heads will likely fall onto the exterior surfaces of certain ones of the containers being filled. If any of the containers become contaminated with the liquid material being filled, it is typically necessary to clean all of the containers, thereby adding considerable filled container cleaning expense to the filling operation. It is desirable, therefore, to provide container filling heads for filling machines which are specifically designed to eliminate any possibility of drippage to thereby promote rapid filling of containers while minimizing the overhead costs that are typically inherent in conventional container filling operations.

During container filling the external surfaces of the filling head will typically collect liquid such as by liquid splashing, liquid foaming, etc. When each filling operation has been completed, the filling head withdrawn from the container and the filled container replaced with an empty one, the collected liquid on the exterior of the filling head will run down the exterior surface. In the case of filling heads such as set forth in U.S. Pat. No. 4,749,010, even though a vacuum drip recovery system is employed which incorporates a tapered dispensing tip having an internal suction passage, some of the downwardly draining liquid material from the entire external surface of the filling head will bypass the vacuum drip recovery system and fall from the filling head. It is desirable therefore to provide a system for removing any external accumulation of liquid from a major portion of the filling head as it is being withdrawn from the container so that upon clearing the container the filling head, except for its lower tip will be free of any descending liquid, only the accumulation of liquid present on the dispensing tip will be subject to vacuum recovery, which is easily accommodated.

PRIOR ART

Container filling apparatus have been developed for container filling machines wherein filling heads are provided for vacuum systems for the purpose of drawing off excessive liquid from overfilled containers and for the purpose of vacuum removal of drips from the lower ends of the filling heads. U.S. Pat. Nos. 3,037,536 and 3,834,430 of Fechheimer, et al., U.S. Pat. No. 3,324,904 of Caruthers, and U.S. Pat. No. 4,749,010 of Petell disclose filling machines incorporating sources of vacuum for excess removal of liquid from containers. U.S. Pat. Nos. 3,870,089 of Laub III, 4,749,010 of Petell, and 4,860,804 of Yamaguchi, et al. disclose filling apparatus having filling heads provided with an anti-drip suction mechanism adapted to draw off air above the fluid level in the container and to pick-up drips from the nozzle tip. Other prior art patents of interest are U.S. Pat. No. 3,741,263 of Wax lax, U.S. Pat. No. 3,792,724 of Hunter and U.S. Pat. No. 4,967,814 of Day. It should be born in mind that the vacuum of the device of Laub III is on when the valve leaves the container and is off before it reaches the next container. This purpose of this continuous vacuum, therefore, is to clear the valve internally of excess fluid but it does not eliminate the fluid on the external surfaces of the valve. Accordingly, drips will continue to occur from the valve of Laub III during cycling from container to container.

SUMMARY OF THE INVENTION

It is a principle feature of this invention to provide a novel method and apparatus for rapid and successive filling of containers wherein drippage from the filling heads of container filling machines is eliminated.

It is another feature of this invention to provide a novel filling head for multiple head filling machines which incorporates separate vacuum systems for removal of excess fluid, foam, etc. from containers being filled and to prevent drippage from the filling heads between filling cycles.

It is also a feature of this invention to provide a novel anti-drip container filling head incorporating an external wiping system to wipe accumulated liquid from the external surfaces of the filling head and into the container as the filling head is withdrawn from the container so that only a very minor accumulation of descending liquid need be accommodated by the vacuum drip recovery system thereof and the possibility of any drippage during containers interchange can be virtually eliminated.

It is an even further feature of this invention to provide a novel dripless filling system having the capability of rapidly and successively filling containers with liquid material and which avoids the possibility of bending or otherwise damaging the filling heads in the event a container should be misaligned relative to a filling head as its filling cycle is initiated.

It is also an important feature of this invention to provide a novel method and apparatus for dripless filling of containers which is simple in nature, reliable in use and low in cost.

It is another feature of this invention to provide a novel method and apparatus for dripless filling of containers wherein a tip design is employed which substantially eliminates foaming during the filling of containers.

Briefly, the several objects and features of the present invention are realized by the provision of filling heads for multiple head container filling machines that are capable of rapidly and successively filling multiple containers with a liquid being supplied to the filling machine. The term "liquid" as employed herein is intended to include compositions such as slurries including liquids and solids and a wide variety of products that are capable of flowing under application of pressure and are capable of movement by pumping operations. In the preferred embodiment of the invention, filling heads are provided which each incorporate a liquid supply housing disposed in communication with a source of liquid to be dispensed. From the liquid supply housing depends an elongated supply conduit forming a passage through which the liquid flows as it is dispensed into the container. At the lower end of the supply conduit is provided a sharply tapered tip which forms dispensing openings through which the liquid is projected from the flow passage of the supply conduit into the container. These dispensing openings may be formed by a portion of the tip structure or may be formed by the lower end of the supply conduit or by both. Additionally, the tapered tip defines a vacuum passage which opens at the point or extreme lower end of the dispensing tip. The outer configuration of the tip is such that any residual liquid that may descend along its outer surface will be directed to the point of the tip at the vacuum opening. A drip collection tube is connected at its lower end to the inner structure of the tip and provides a vacuum passage extending upwardly through the supply conduit and the liquid supply housing. The vacuum tube is disposed in communication with a source of vacuum which induces any drops of liquid that descend to the lower portion of the tip to be drawn through the vacuum passage and returned to a liquid reservoir forming a component part portion of the vacuum source.

A spring urged shroud is disposed in movable relation about the supply conduit and forms the valve seat at its lower end which is engaged by an annular seal carried by the tip. In the closed condition of the nozzle, the annular seal engages the tapered seal surface and develops a seal between the tip and the shroud. The shroud may form an annular passage about the supply conduit which passage is in communication with the supply reservoir to return excess liquid and foam to the supply reservoir for use in filling other containers. The annular passage is normally closed by the dispensing tip and the annular seal and is opened to permit evacuation of the container during filling, when the dispensing openings of the supply conduit and tip are exposed during filling of a container. To minimize descending accumulated liquid along the external surfaces of the filling head the shroud disposed about the filling head incorporates a wiper which wipes accumulated liquid into the container as the filling head is being withdrawn from the container after filling it, thus leaving accumulated liquid only at the tapered tip. This small accumulation of liquid is easily recovered by the vacuum drip recovery system of the filling head.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

In the Drawings

FIG. 1 is a partially mechanical schematic illustration of a container filling system constructed in accordance with the present invention and incorporating a filling nozzle of the nature set forth herein.

FIG. 2 is an elevational view of a filling nozzle construction representing a preferred embodiment of this invention.

FIG. 3 is a sectional view of the filling nozzle of FIG. 2, showing the nozzle in its valve open, container filling condition.

FIG. 3A is an enlarged partial sectional view showing the lower portion of the nozzle construction of FIGS. 2 and 3.

FIG. 4A is a partial sectional view of a container filling nozzle representing an alternative embodiment of this invention and showing the nozzle in its valve open, container filling condition, with a container being shown by way of broken lines.

FIG. 5 is a bottom view illustrating the nozzle adjustment plate of the embodiment shown in FIG. 4.

FIG. 5A is a partial sectional view representing an alternative embodiment of this invention for establishment of a seal with the container during filling.

FIG. 6 is a partial sectional view of the filling nozzle construction of FIG. 4 being illustrated in the valve closed position with a container being shown by way of broken lines.

FIG. 7 is a sectional view of a container filling nozzle represents an even further embodiment of this invention.

FIGS. 8 and 9 are partial sectional views of a container filling nozzle such as shown in FIG. 4 and illustrating an alternative vacuum system for vacuum removal of drips from the tip of the nozzle.

FIG. 10 is a sectional view illustrating a container filling nozzle representing a further alternative embodiment of this invention such as for the filling of drums and which incorporates a vacuum system for removing drips from the lower portion of the nozzle and for removal of air and hazardous vapor from the container during filling, the nozzle being shown in its closed position.

Figure 11:
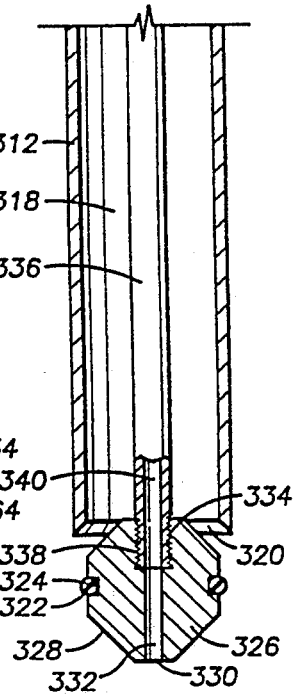

FIG. 11 is a fragmentary sectional view of a filling nozzle representing a further alternative embodiment of this invention and showing the nozzle in its open, container filling position.

DETAILED DESCRIPTION OF PREFERRED EMBODIMENTS

Figure 1:
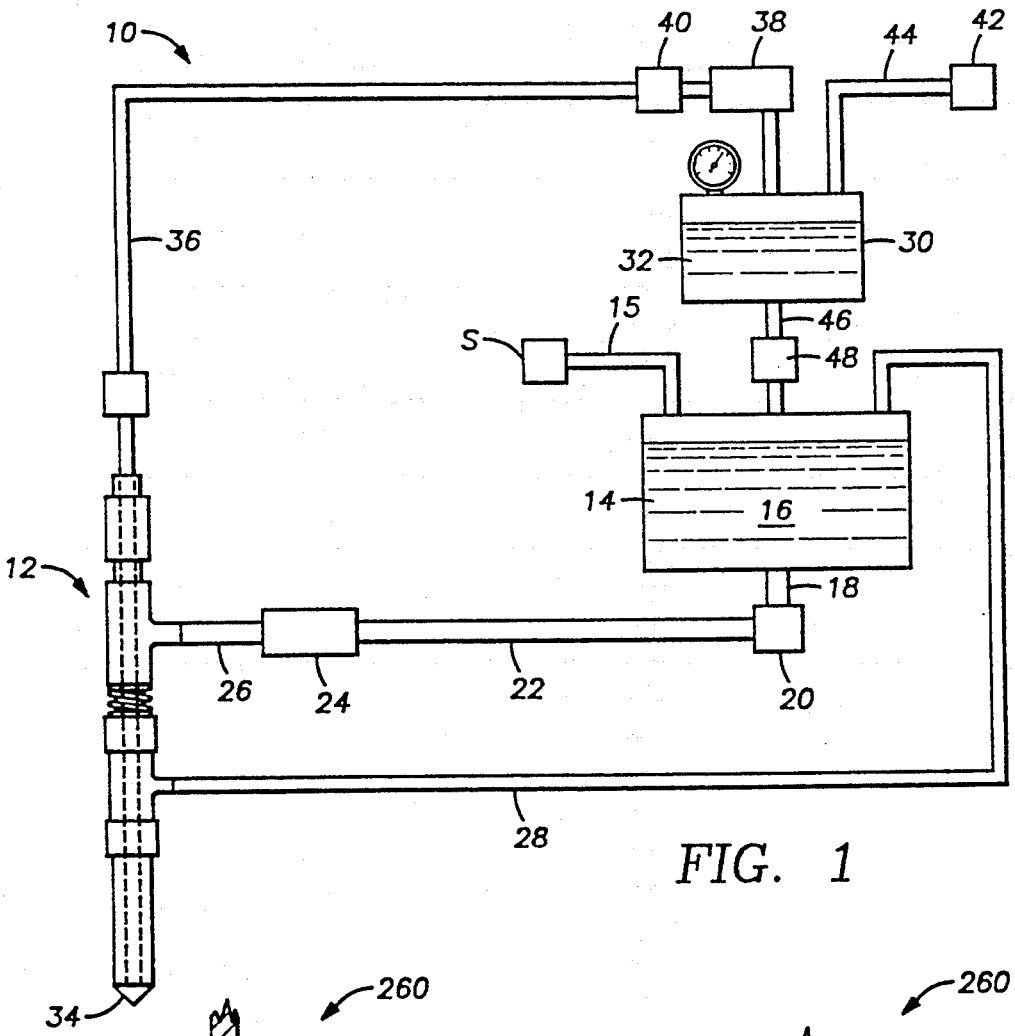

Referring now to the drawings and first to FIG. 1, a filling system constructed in accordance with the present invention is illustrated generally at 10 which includes a container filling head or nozzle illustrated generally at 12. The filling system incorporates a holding tank 14 of a filling machine which forms a reservoir 16 into which a quantity of liquid material is placed. The liquid material being filled into containers may be transferred from a liquid supply source "S" through a supply conduit 15. An outlet conduit 18 projects from the holding tank 14 and forms a passage in communication with the product reservoir. A filler valve pump 20 is provided with its inlet in communication with the supply passage of the conduit 18 and with its discharge in communication with a supply passage defined by a supply conduit 22. The supply conduit may connect directly with the product inlet of the nozzle construction 12 or, in the alternative, it may communicate with a supply manifold 24 to which the product inlet of the filling head or nozzle 12 is connected by means of an appropriate connecting conduit 26. A product overflow conduit 28 extends from the container filling nozzle 12 and is in communication with the product reservoir 16 so as to return any product overflow back to the reservoir 16 for use in subsequent filling operations.

A vacuum vessel 30 forming a vacuum chamber 32 is provided to return any drippage from the nozzle 12 back to the supply reservoir 16. A vacuum passage 36 extending from the tapered tip 34 of the filling nozzle 12 is communicated by means of a vacuum passage to the reservoir 32 of the vacuum chamber. A vacuum manifold 38 may comprise a part of the vacuum passage 36, thus permitting a plurality of vacuum lines from filling nozzles to be communicated via the manifold 38 with the vacuum chamber 32. The manifold 38 is provided with a valve actuator 40 being associated in controlling relation with the filling head or heads for the purpose of insuring application of vacuum to the nozzle tip or tips during periods when liquid is not being dispensed from the respective nozzle. The vacuum chamber 32 is disposed in communication with a suitable source of vacuum such as a vacuum pump 42 by means of a vacuum conduit 44. To insure against loss of drippage collected from the various nozzle tips of the dispensing system, a transfer conduit 46 is connected to the vacuum vessel 30 and to the product holding tank 14 and is controlled by a dump valve 48. Upon accumulation of recovered liquid within the vacuum chamber, the dump valve may be selectively opened to transfer collected liquid from the vacuum chamber to the liquid supply reservoir.

Figure 2:
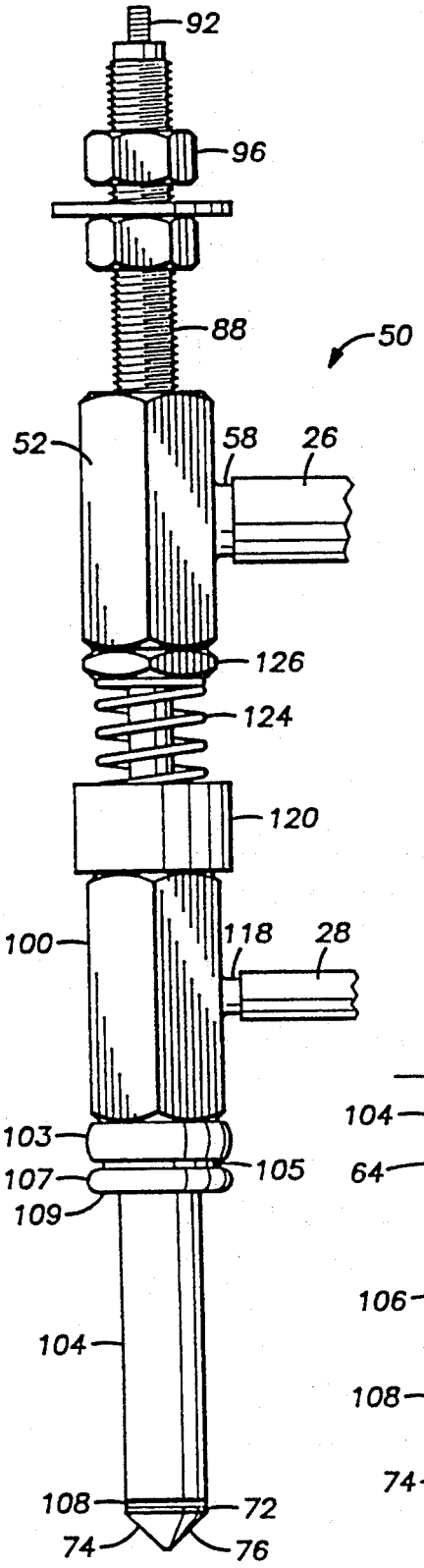
Figure 3A:
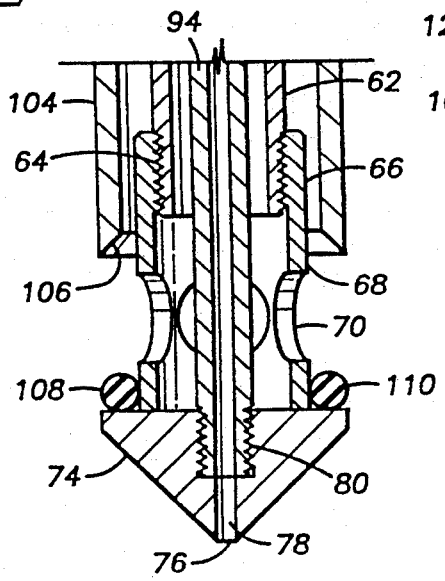
Figure 3:
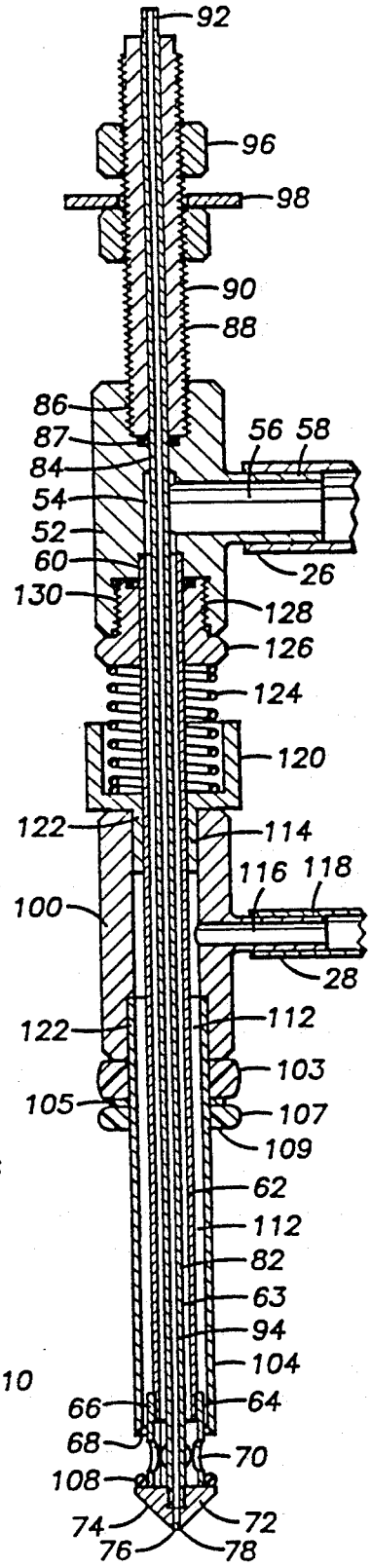

With reference now to FIGS. 2, 3 and 3A, the filling head or nozzle 12, illustrated in FIG. 1, may take the form shown in FIGS. 2 and 3 or as set forth in other figures of the drawings. The container filling nozzles which are illustrated generally at 50 in FIGS. 2 and 3 incorporate a liquid supply housing 52 forming an internal supply chamber 54 which is disposed in communication with a liquid supply passage 56. The liquid supply passage is formed in part by a tubular connector 58 which may be formed integrally with the housing 52 or, in the alternative, may be suitably connected thereto. The tubular connector 58 is adapted to receive a supply conduit such as that shown at 26 in FIG. 1. Preferably, the supply conduit 26 is composed of a flexible tubular material which may have any suitable form or composition within the spirit and scope of this invention. The lower portion of the housing 52 defines an internally threaded section 60 which receives the externally threaded upper portion of a liquid dispensing tube 62 which forms a dispensing passage 63. the dispensing passage also defines an externally threaded lower extremity which is received within the internally threaded upper extremity 66 of a tip connection tube 68. The tube 68 forms a plurality of dispensing openings 70 through which the liquid material is dispensed into the container when the nozzle is in the position shown in FIG. 3. The connector tube 68 forms support for a tapered dispensing tip 72 having an externally tapered surface 74 formed thereon and being of sufficiently sharp taper to direct any of the external drippage of the nozzle downwardly to the downwardly projecting point 76 of the tip. A drip collection passage 78 is formed in the lower portion of the tip in intersecting relation with the point 76 so that any drips of liquid that descend onto the tip are conducted by the sharply tapered surface 74 to the inlet opening of the passage 78. As will be explained n detail hereinbelow, the filling head of the preferred embodiment is provided with an external wiper that wipes accumulated liquid from the exterior of the filling head and into the container as the filling head is being withdrawn from the container. Thus, the only remaining accumulated liquid will be present only at the lower end of the filling head, particularly at the tapered surface 74 of the tip. All of this small accumulation of liquid is easily recovered by the vacuum passage 78. Thus, virtually no drips will occur during container interchange so the work station remains clean and all of the product is used.

The downwardly projecting tip 72 of the nozzle is provided with an internally threaded section 80 which receives the lower externally threaded end of a drip collection tube 82. The tube 82 extends upwardly from the tip 72 through the liquid dispensing tube 62 and through the liquid supply chamber 74 of the housing 52 and projects through an opening 84 defined within the upper portion of the housing 52. Thus the dispensing passage 63 is defined by an annulus between the dispensing tube 62 and the drip collection tube 82. At its upper end, the housing 52 also defines an internally threaded section 86 which receives an externally threaded support or fastener tube 88. The support tube forms an internal passage 90 through which the upper end of the drip collection tube 82 extends. At its upper end the drip collection tube defines an externally threaded section 92 which is adapted to receive an appropriate fitting, not shown, for the purpose of connecting the vacuum conduit 36 of FIG. 1 thereto. Thus, vacuum from the vacuum chamber 32 of FIG. 1 is conducted via the manifold 38 to the vacuum conduit 36 and thence into a vacuum passage 94 defined by the drip collection tube. The vacuum is thus capable of being applied to the drip collection passage 78 of the tapered tip 72 under the control of the valve 40 regardless of the position of the nozzle tip 72. The support tube 88 is provided with nuts 96 and a washer 98 for the purpose of securely attaching the container filling nozzle relative to any suitable nozzle support structure of the dispensing machine.

For the purpose of filling containers, it is appropriate that the filling nozzle be capable of positioning at a closed position as shown in FIG. 2 and at an open position as shown in FIG. 3. One suitable means for accomplishing this feature may take the form conveniently shown in FIGS. 2 and 3 wherein a shroud housing is shown to be disposed in movable relation with the liquid dispensing tube 62..The shroud housing 100 defines an internally threaded section 102 that receives the externally threaded upper end of a shroud tube 104. The lower end of the shroud tube forms a tapered sealing surface 106 which is disposed for sealing engagement with an elastomer O-ring or other suitable seal 108 which is supported by an annular support shoulder 110 projecting radially beyond the tip support tube 68. The sealing surface 106 and the seal 108 together with seal support shoulder 110 form a normally closed filling valve which is opened when the dispensing tube is moved downwardly relative to the shroud housing and tube 100–104.

The shroud tube 104 is disposed in substantially coaxially, spaced relation with the liquid dispensing tube 62 and thus defines an annulus 112 which is coextensive with a similar annulus 114 that is defined by the shroud housing about the liquid dispensing tube. An overflow passage 116 is defined in part by the shroud housing and in part by a connection tube 118 projecting laterally from the housing 100. The overflow return tube 28 of FIG. 1 is secured about the connecting tube 118 and functions to return any liquid overflow to the liquid supply reservoir 16. In order to compensate for the differences in the height of different containers to be filled, one or more spacers 105 will typically be positioned about the shroud tube 104 and one or more gaskets 107 will be disposed about the shroud tube below the lowermost spacer, with the lower spacer forming an annular shoulder 109 for contact with the upper end of a container being filled. The spacers are typically composed of metal while the gaskets are composed of any one of a number of suitable materials such as rubber, polymer, cork, etc.

In order to impart vertical movement to the shroud housing 100 and the shroud tube 104 relative to the liquid dispensing tube 62 and the nozzle tip 72, a spring retainer element 120 is shown to be received in movable relation about the liquid dispensing tube. The spring retainer defines a downwardly extending circular projection 122 which is received within the upper portion of the overflow return passage defined by annulus 114 to thereby stabilize the spring retainer in relation to the shroud housing. The spring retainer forms s receptacle within which is received the lower end of a compression spring 124 while the upper end of the compression spring is disposed in abutment with a seal retainer 126. The seal retainer is in turn secured by s threaded connection 128 to the lower end of the liquid supply housing 52. At its upper portion the seal retainer 126 secures a circular sealing element 130 in position to establish a positive seal between the outer surface of the liquid dispensing tube 62 and the inner surface portion of the liquid supply housing 52.

Except during filling of containers, the filling nozzle 50 is in the condition shown in FIG. 2 with the shroud and shroud tube urged downwardly by the compression spring 124 thus maintaining the tapered sealing surface 106 of the shroud tube in sealing engagement with the annular sealing member 108. During a container filling operation the nozzle construction will be moved downwardly by the filling machine, thus inserting the shroud tube through the opening of the container until the shoulder 109 defined by the lower gasket 107 shroud housing contacts the upper end of the container. The container then restrains further downward movement of the shroud and shroud tube. Continued downward movement of the upper portion of the nozzle construction by the filling machine will induce further compression of the spring 124 and will cause the tip 72 and seal 108 to be moved downwardly to the position shown in FIG. 3 to thus permit liquid to be dispensed through the openings 70 of the tip support tube 68. Typically this activity is accomplished with the vacuum control valve 40 closed so that fluid being dispensed into the container will not be drawn through the passage 78 of the tip into the passage 94 of the drip collection tube. The filler pump 20 is then activated causing liquid to be pumped through the supply conduit 22 from the reservoir 16 and through passages 54-56-63 to the openings 70 for discharge of the liquid into the container being filled.

After the container has been filled with a proper volume of liquid the filling machine will begin upward movement of the nozzle. Upon initial upward movement of the nozzle, the gasket shoulder 109 will maintain its contact with the upper end of the container by virtue of the downward force applied thereto by the compression spring 124. After sufficient upward movement has occurred that the seal 108 is brought into sealing engagement with the tapered seat surface 106, further upward movement of the upper portion of the nozzle will begin to extract the shroud tube 104 from the container. After sufficient upward movement of the nozzle has occurred so that the downwardly projecting tip 72 is clear the liquid level in the container the vacuum control valve 40 will be opened and vacuum will be communicated through the conduit 36 and the passage 94 of the drip collection tube through the opening of passage 78 at the point 76 of the tip. The filling nozzle will thus be in the condition shown in FIG. 2 and any residual liquid present on the outer surfaces of the filling nozzle will typically descend along the outer surface of the shroud tube 104 to the tip 72. Thereafter, the descending liquid will be conducted by the tapered surface 74 of the tip to the opening of passage 78 at the point 76 where it will be drawn by the vacuum upwardly through the passage 94 and through conduit 36 to the vacuum chamber 32. Additionally, the filling head on nozzle 50 of FIGS. 2, 3, and 3A may be provided with a wiping shroud such as shown at 142 in FIGS. 4 and 6 if desired. The sharply tapered configuration of the tip surface 74 will insure against any drippage from any peripheral portion of the nozzle and thus all of the liquid descending onto the tip will be recovered through the vacuum passage 94 and may then be returned to the supply reservoir 16 for subsequent container filling.

Figure 4:
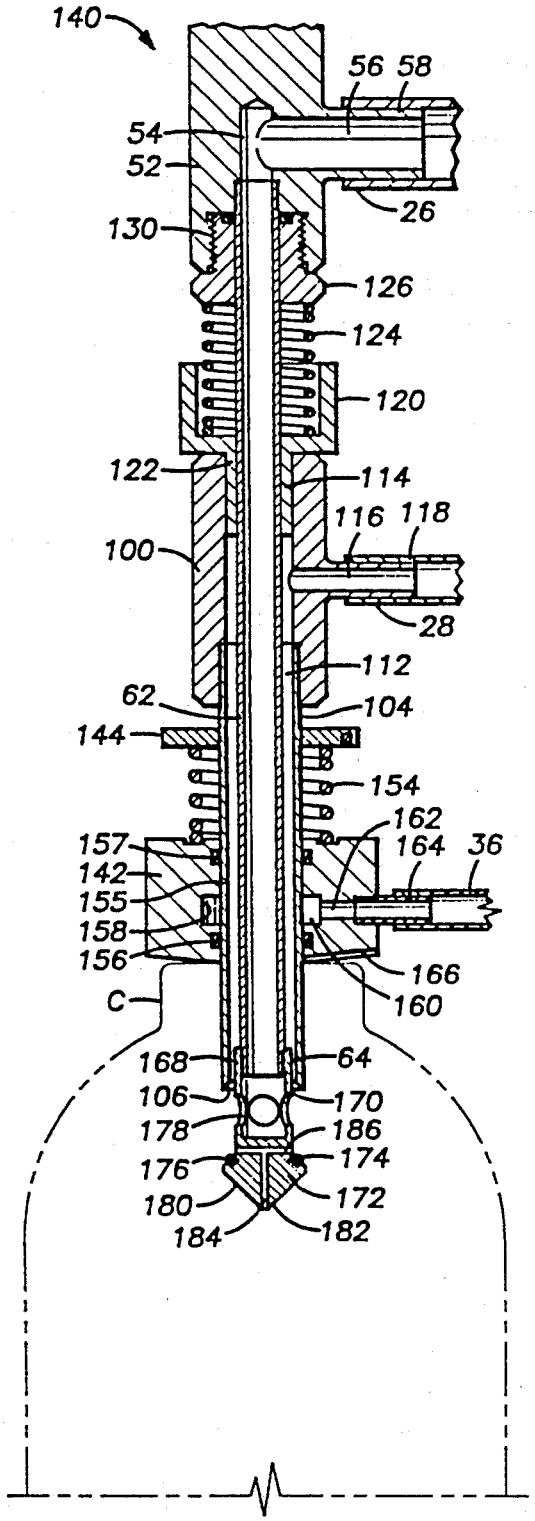

Referring now to FIG. 4 an alternative embodiment of the present invention is disclosed, with like parts in comparison with FIGS. 2 and 3 being identified by like reference numerals. The upper portion of the filling nozzle shown generally at 140 is quite similar to the upper portion of the filling nozzle 50 shown in FIGS. 2 and 3, with the exception that the liquid supply housing 52 does not define a through passage such as that shown at 84 in FIG. 3 for the reason that a drip collection tube such as that shown at 82 in FIG. 3 is not employed. Thus, the liquid supply chamber 54 is simply defined by a blind bore that is disposed in intersecting relation with the liquid supply passage 6. It should be born in mind however that an internal drip collection tube such as that shown at 92 in FIG. 3 could be employed in the embodiment of FIG. 4 if desired.

The dispensing nozzle incorporates a shroud housing 142 that is movably received about the outer cylindrical surface defined about the tube 104. In this case the tube 104, rather than being a shroud tube, is supported by the housing 100 which functions as an overflow housing. The overflow conduit 28 may be in communication with a source of vacuum for efficient removal of overflow product and foam that may occur upon filling of the containers and to provide for efficient venting of the containers during filling.

Figure 5:
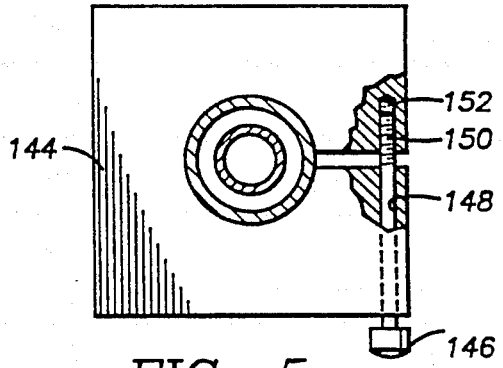

A split adjustment plate 144 which is shown by way of the bottom view of FIG. 5 is adjustably positionable along a portion of the length of the outer tube 104 to vertically locate the operative position of the shroud 142 and to provide for adjustment of different fill heights (levels of fluid within the containers). The adjustment plate also permits adjustment of the valve opening position of the filling head or nozzle relative to the container. This flexibility of design enables the apparatus to be employed efficiently for filling a wide variety and size of containers. The shroud, being of substantial width, will accommodate containers having a wide variety of opening sizes. In contrast, for example, the filling head of Petell (U.S. Pat. No. 4,749,010) has a tight fit with the internal dimension of the container opening and thus would be restricted to the filling of containers with openings of that particular size and configuration. The split adjustment plate 144 is tightened about the tube 104 by means of a bolt 146 which is extended through a passage shown in broken lines at 148 and is provided with a threaded extremity 150 which is received by an internally threaded receptacle 152 of the plate 144. The adjustment plate is adjustable along the length of the tube 104 to compensate for containers of differing heights. A compression spring 154 is interposed between the position adjustment plate 144 and the shroud 142 and is operative to impart a downwardly directed force to the shroud. The split adjustment plate 144 greatly simplifies typical valve adjustment procedures. In typical container filling machines one person must climb onto the machine and adjust the height of the valve while another person will typically test the height of the valve in relation to the containers to be filled. In accordance with the present invention, one person can adjust the height of the container filling valve simply by loosening and resetting the adjustment plate 144. Since the adjustment plate is near the lower end of the valve, one person can readily achieve adjustment and inspection of the position of the valve relative to the container. The tapered lower surface of the shroud 142 also functions to align or displace any container that is not properly aligned in its filling position in respect to the filling head. If the container is slightly misaligned with respect to the filling head, the tapered lower surface of the shroud will center the container before the lower portion of the filling head enters the container. If the container is grossly misaligned, the tapered lower surface of the shroud will cause the container to be kicked away from its misaligned position. The container is either aligned with the filling head or displaced from the filling head by the action of this tapered surface. This feature effectively permits the filling heads from becoming bent in the event a container should be misaligned for any reason.

The shroud 142 defines a vertically oriented passage 155 through which the outer tube 104 of the nozzle extends in relatively close fitting movable relationship. Annular seal members 156 and 157 retained within internal seal groove of the shroud maintain a sealed relationship between the tube 104 and shroud 142 and permit relative movement of the shroud and tube. The seal ring 156 also serves as a wiper to wipe away the accumulation of liquid that is typically present on the lower portion of the dispensing tube so that the only liquid that might drip is that located on the nozzle tip. Any drippage from this minimal remaining liquid is easily recovered by the vacuum system so that no drippage will occur during the container replacement period when no container is present below the filling head. The shroud also defines an internal groove 158 which forms an annular chamber 160 about the outer tube 104. This chamber is in communication with a vacuum passage 162 which is formed by the shroud. A connection tube 164 is threadedly or otherwise connected to the shroud and forms a tubular connection that is adapted to receive a valve controlled vacuum conduit such as that shown at 36 in FIG. 1.

Figure 6:
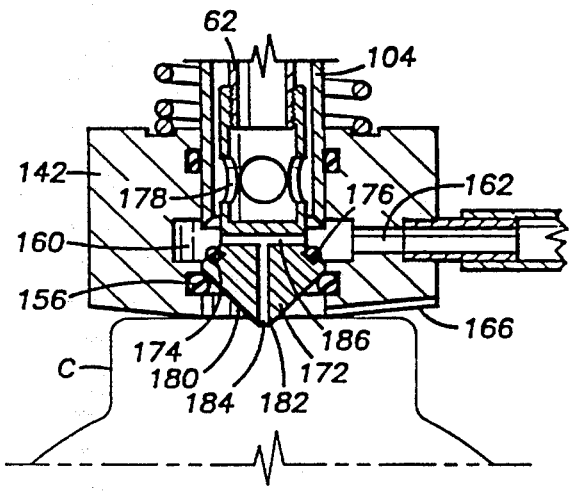

As shown in FIGS. 4 and 6 the shroud 142 further defines a recess 166 along the lower surface thereof which extends from the passage 155 to the outer periphery of the shroud. When the lower surface of the shroud is disposed in engagement with the container shown in broken lines at "C" and liquid product is introduced into the container through the open valve, the air in the container will be displaced through the vent recess 166 to the atmosphere.

Figure 5A:
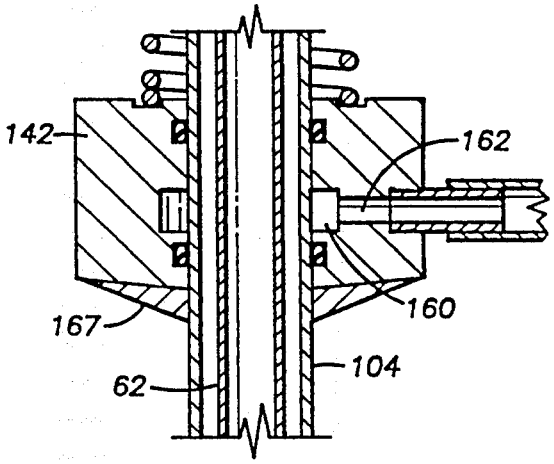

Although apparatus is provided for venting of a container as shown in FIGS. 4 and 6, it may also be desirable to establish a positive seal at the mouth of the container. For example, if vacuum venting of the containers is desired such as venting by way of vacuum communication to the overflow passage and conduit, especially for high volume filling, the lower surface of the shroud 142 may establish sealed engagement at the container opening as shown by FIG. 5A. As shown in FIG. 5A a shroud structure similar to that shown at 142 in FIGS. 4 and 6 may be provided with a tapered resilient gasket 167 which forms the lower surface portion of the shroud and which is disposed for sealing contact with the upper end of a container being filled. When the apparatus of FIG. 5A is employed, air being expelled or being drawn by vacuum from the container will flow upwardly through the annulus 112 to the overflow passage 116 in the manner discussed above in connection with FIG. 4.

At the lower portion of the liquid dispensing tube 62 is provided an externally threaded section 64 which is received by an upper internally threaded portion 168 defined by an upwardly extending tubular portion 170 of a nozzle tip 172. The nozzle tip forms a seal recess 174 within which is received a circular seal member 176 such as an elastomeric O-ring or the like, for the purpose of establishing a seal with the downwardly directed tapered surface 106 of the outer tube 104. The tubular portion 170 of the tip further defines a plurality of dispensing outlet openings 178 through which the fluid is projected as it is dispensed into the container "C".

The lower portion of the tip 172 forms a tapered surface 180 having a rather sharp taper that directs any drippage on the lower portion of the nozzle downwardly to a pointed lower end 182 of the tip. The tip construction further defines a drip collection passage 184 which extends vertically from the point 182 of the tip and is intersected by a transverse passage 186 located above the seal member 176. In the alternative, the nozzle tip of the embodiment of FIG. 4 may conveniently take the general form shown in FIGS. 3 and 3A, or 7 if desired.

In the illustration of FIG. 4, the nozzle tip is shown to be in its lowermost, open position by virtue of the spring 124 being compressed by reaction of the shroud against the upper end of the container "C". The force from the shroud traverses through the spring 154 and the adjustment plate 144 to the outer tube 104 and thence through the housing structure 100 and spring retainer 120 to the upper compression spring. During this force inducing process the spring 154 is also compressed. As the upper end of the filling head or nozzle construction is moved upwardly by the nozzle support structure of the filling machine, the spring 124 will expand, thereby shifting the body and outer tube downwardly relative to the liquid dispensing tube 62. This causes the tapered sealing surface 106 and the seal 176 to engage, thus closing the dispensing outlet of the nozzle. With the nozzle opened as shown in FIG. 4, any fluid overfill that might occur during the filling operation will be evacuated through the annulus 112 between the inner and outer tubes, thus causing the excess liquid to be drawn off and returned by passage 116 and tube 28 to the supply reservoir 16. Perhaps more importantly venting or vacuum induced evacuation of air from the container occurs through the annulus 112. For rapid, high volume container filling, vacuum induced evacuation is a distinct advantage.

As the lower portion of the dispensing nozzle is being withdrawn from the container at the termination of the filling operation, vacuum is applied to the tip structure shortly before valve closure in order to clear the tip of any liquid that might be present within the passages 184 and 186 and that might be present on the lower outer surfaces of the tip structure. As the nozzle is being withdrawn, the spring 154 will keep the shroud housing 142 in contact with the upper end of the container C thus, in essence, causing downward movement of the shroud housing relative to the outer tube 104. During this movement, the lower seal 156 of the shroud housing will develop a wiping effect on the outer tube 104 thus causing any liquid present on the outer tube to be wiped downwardly toward the tip 172 and into the container. Thus no liquid accumulation will remain on the outer tube 104 to run down and drip. The small amount of residual liquid that exists will be on the tip. This small quantity is easily recovered by the vacuum induced anti-drip system of the filling head. At this time the tip will be moving towards its closed position. Shortly before contact between the seal 176 and the sealing surface 106, the lower end of the outer tube 104 will have moved to a position at or above the annular vacuum chamber 160 thereby causing the vacuum which is operative via vacuum passage 162 to be in communication with the transverse passage 186. When this occurs the passages 184 and 186 will be cleared of liquid by the vacuum and any liquid descending along the outer surfaces of the tube and tip will have been directed to the vacuum opening at the lower point 182 of the tip. Any drips of liquid remaining on the outer surface of the tip will collect at the opening 182 and be drawn by the vacuum through passages 184 and 186 into the annular chamber 160 where the dripped liquid is then returned to the vacuum chamber of the liquid supply. Application of vacuum to the tip in this manner will insure that drippage will not occur during the period when a succeeding container is being positioned beneath the filling nozzle.

As upward movement of the housing 52 and tube 62 continues, the compression spring 154 will thus expand, causing downward movement of the shroud 142 relative to the outer tube 104. This downward movement will continue until the transverse drip collection passage 186 of the tip is disposed in registry with the annular groove 158. When this occurs, the vacuum acting within passage 162 and the annulus 160 defined by the groove 158 causes any drips that descend to the point of the tip on the tapered surface 180 to be drawn upwardly through the passage 184 and laterally through the passage 186 to the annulus and thence to the passage 162. The drippage thus collected is thereby returned to the vacuum chamber 32 in the manner discussed above in connection with FIG. 1.

Referring now to the fragmentary sectional view of FIG. 6, the nozzle tip 172 of the apparatus of FIG. 4 is shown in its closed position which would occur when the filling head is raised sufficiently from the FIG. 4 position sufficiently that the shroud is located at its lowermost position relative to the outer tube 104. In this position the annulus is in registry with transverse passage 186 of the tip 172.

Figure 7:
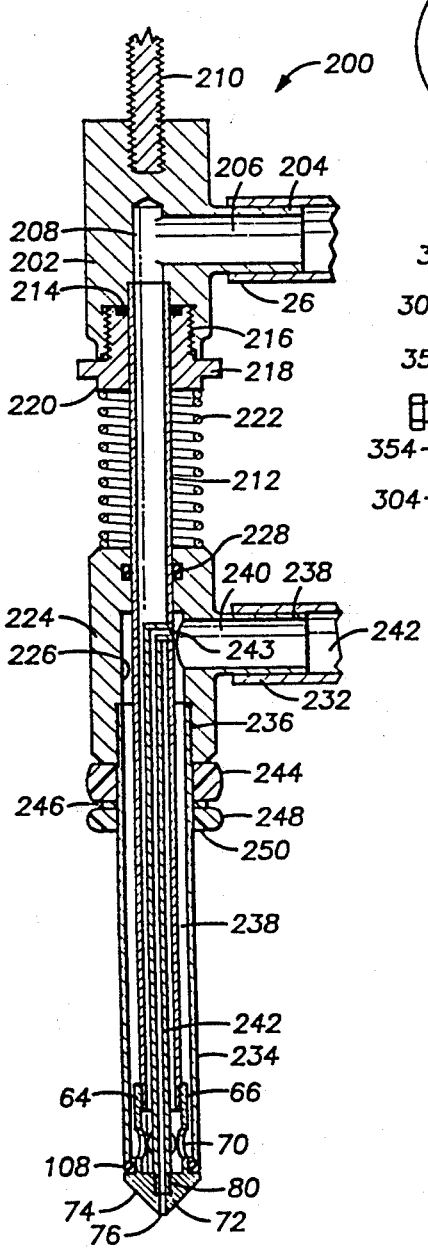

Referring now to FIG. 7 a further alternative embodiment of the present invention is shown generally at 200 which incorporates a dispensing housing 202 having an inlet connection 204 extending therefrom and adapted to receive a fluid supply tube 26 in the same manner as discussed above in connection with FIGS. 2 and 4. The inlet connection 204 forms an inlet passage 206 which is in communication with an internal fluid supply chamber 208 defined by the body 202. A threaded support stem 210 projects upwardly from the liquid supply housing and is provided with appropriate nuts and washers in the manner shown in FIG. 2 so that the nozzle construction may be appropriately secured relative to the structure of the filling machine. A liquid dispensing tube 212 is threadedly engaged within the housing 202 and is sealed with respect to the housing by means of an annular sealing element 214 that is secured in place by a seal retainer 216 which is also threadedly secured to the housing structure 202. The retainer 216 is provided with flats 218 in the form of a conventional nut thereby permitting the retainer to be assembled and disassembled relative to the housing by means of simple wrenches. A spring retainer 220 is formed on or secured to the retainer 218 and provides for proper positioning of the upper end of the compression spring 222. The lower end of the compression spring is disposed in aligned abutment with the upper end of a shroud housing 224 which forms a passage 226 through which the liquid dispensing tube 212 extends. The shroud housing is sealed with respect to the dispensing tube by means of an annular sealing element 228.

The shroud housing 224 forms a transversely projecting connection tube 230 which receives an overflow tube 232 in sealed relation therewith. A shroud tube or external nozzle tube 234 is provided with an externally threaded upper extremity 236 which is received in threaded engagement within an internally threaded section formed by the shroud housing 226, thus supporting the shroud tube 234 in substantially concentric, spaced relation with the liquid dispensing tube 212. This relationship forms an annular space or annulus 238 between the tubes 212 and 234, which annulus is in communication with a vacuum passage 240 that is defined by the connector tube 230 and the overflow tube 232.

At its lower portion the nozzle construction 200 defines a tip 72 which is of essentially the same construction and function as that shown and described in connection with FIGS. 2, 3 and 3A. Accordingly, like parts are identified by like reference numerals. A drip collection tube 242 is positioned centrally of the liquid dispensing tube 212 with its lower threaded end 80 received by the internally threaded opening of the tip 72. The drip collection tube 242 differs from that shown at 82 in FIG. 3 in that it projects upwardly from the tip to the shroud housing 224 and then projects laterally to an opening 243 in the tube 212, which opening is in registry with the passage 240 of the connector 230. The vacuum tube 242 is thus disposed in communication with a source of vacuum such as the vacuum chamber 32 of FIG. 1 which is applied via tube passage 242. Throughout the range of movement of the shroud member 224 relative to the dispensing member 212 the port 243 will be exposed to the passage 240 to thus enable vacuum to be applied to the tip by the drip collection tube 242. To compensate for height of containers being filled by the filling nozzle 200 a spacer member 244 of a predetermined thickness is assembled about the shroud tube 234. A washer 246 and a gasket 248 are also disposed about the tube 234. The thickness of the spacer 244 is selected according to container height such that the lower shoulder 250 is positioned for contact with the upper end of the container being filled. Further downward movement of the housing 202 by the filling machine will then induce downward movement of the liquid dispensing tube and accomplish opening of the dispensing valve by shifting the tip 72 to its open position in the manner shown at the lower portions of FIGS. 3 and 3A. When in this position fluid is projected through openings 70 into the container being filled. After the filling operation has been completed, to remove any foam or excess fluid from the container vacuum from the overflow tube 232 is applied through passage 240 and annulus 238. After the dispensing operation has been completed and the valve 200 has been moved upwardly clear of the level of the liquid in the container, vacuum is applied from passage 242 and port 243 through drip collection tube 242 thus communicating the vacuum at the tip opening 76 for recovery of any drips that descend downwardly along the tube 234 and tip surface 74 to the opening 76. By communicating the vacuum to the drip collection opening 76 there is positive assurance that all drips will be collected and that no drippage will fall to the floor or onto other containers as progressive filling operations are being conducted.

Figure 8:
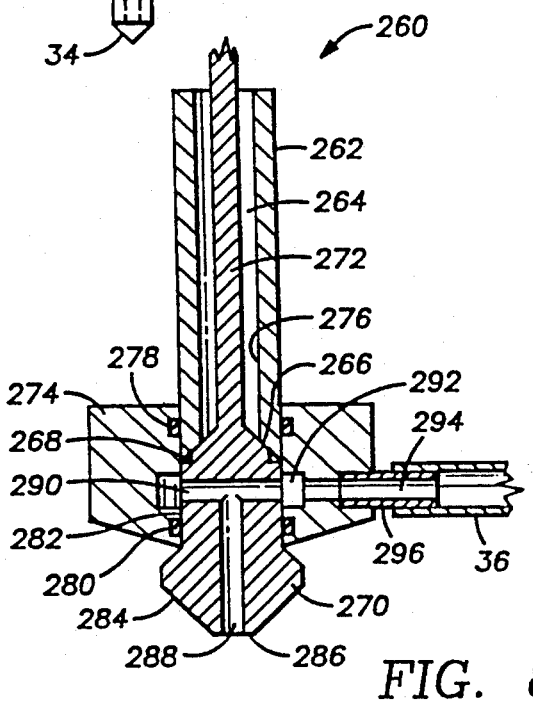
Figure 9:
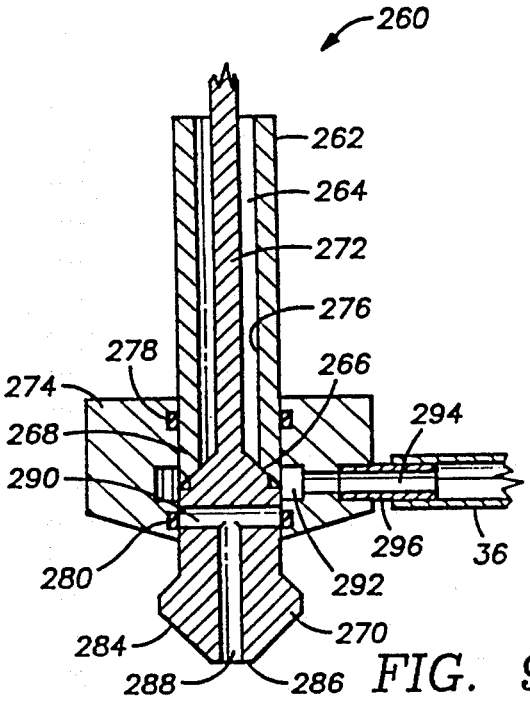

With reference now to FIGS. 8 and 9 another alternative embodiment of this invention is shown generally at 260 wherein a tube 262 forms a passage 264 through which liquid is dispensed into respective containers. This embodiment may also be incorporated with the filling head mechanism of FIG. 7. The tube 262 forms a tapered lower extremity 266 which is disposed for sealing engagement by means of an annular sealing element 268 which is supported by a nozzle tip construction 270 disposed at the lower end of a tip support stem 272. A nozzle shroud 274, which is of a form such as generally shown at 142 in FIG. 4, forms an internal passage 276 through which the tube 262 and an upper portion of the nozzle tip extend. The tube 262 is sealed with respect to the shroud by means of an upper sealing element 278. A lower sealing element 280 is located within the lower portion of the shroud and establishes a seal with a generally cylindrical intermediate portion 282 of the tip.

For the purpose of insuring collection of all drips that descend to the lower portion of the filling nozzle, the tip 270 defines a tapered lower surface 284 which forms a centrally located downwardly directed point 286. A drip collection passage 288 is formed by the nozzle tip and extends upwardly from the point 286. The passage 288 is intersected by transverse passage 290 which is oriented for registry with an annular groove 292 which is also formed by the shroud member 274. The annular groove 292 forms an annular space which is in communication with a vacuum passage 294 which is defined by a connection tube 296 extending from the shroud. The connection tube receives a drip collection vacuum tube 36 such as that shown in FIG. 1 for the purpose of collecting drips from the tip 270 and conducting the recovered liquid to the vacuum chamber. As shown in FIG. 9, the tubes 262 and tip 270 are shifted downwardly so that the annulus formed by the groove 292 is out of registry with the transverse passage 290 of the tip structure. Thus, in this position, drip collection will not be occurring even under circumstances where the vacuum tube 236 is applying a vacuum to the shroud 274. In this condition, therefore, the vacuum tube need not have a valve for its control since the control of drip collection will be influenced by the valving activity of the tip 270.

Figure 10:
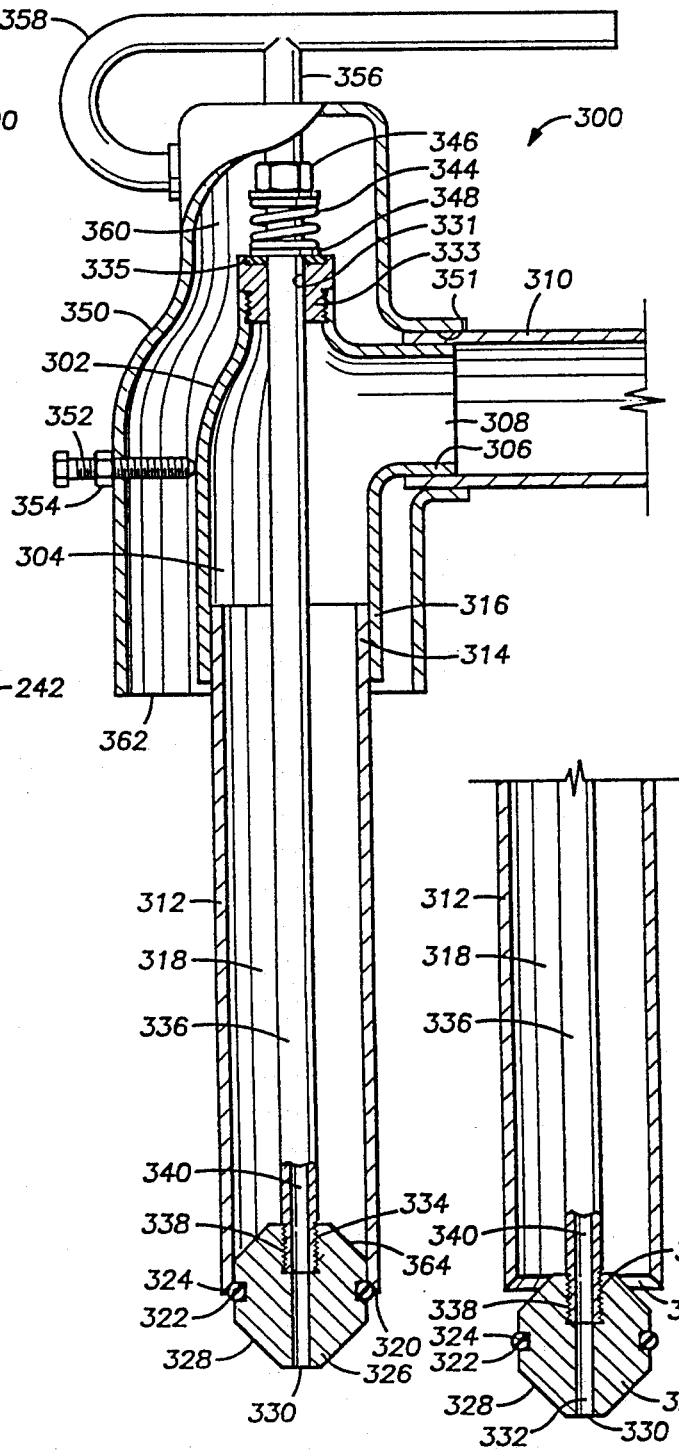

Referring now to FIGS. 10 and 11, an alternative embodiment of this invention is shown generally at 300 which is an embodiment designed specifically for the filling of large containers such as drums. The filling nozzle 300 defines a nozzle housing 302 forming an internal chamber 304 and also forming a transversely extending connector 306 defining an inlet passage 308. The connection 306 receives a supply conduit 310 through which liquid material flows during the container filling operation. A filling tube 312 is provided having its upper externally threaded extremity 314 secured to an internally threaded portion 316 of the dispenser housing and forms an internal passage 318 through which fluid flow is received from the chamber 304. At its lower end the filling tube 312 forms a tapered sealing surface 320 which is disposed for sealing engagement by means of a circular sealing element 322 that is supported within a seal groove 324 formed in the nozzle tip structure 326. The nozzle tip forms a tapered surface 328 that directs any drips descending along the tube 312 and tip to a downwardly directed point 330 of the tip. A drip collection passage 332 extends upwardly through the tip to an internally threaded receptacle 334. A drip collection tube 336 is provided having a lower externally threaded extremity 338 thereof received by the threaded receptacle 334. The drip collection tube 336 forms an internal passage 340 which is disposed in communication with the drip collection passage 332. The tube 336 extends upwardly through the nozzle tube 312 and the nozzle housing 302 with the upper end of the tube being received through an opening 331 in a seal retainer 333 which is threadedly attached to the housing 302. A seal member 335 is disposed in a seal recess of the seal retainer to prevent leakage along the drip collection tube. At the upper portion of the tube 336 is provided a compression spring 344 which is maintained in compression by an adjustment nut 346 having its upper and lower ends bearing against support washers 348, with the lower washer engaging the seal 335. A downwardly directed force may be applied to the upper end of the compression spring, thereby causing downward movement of the drip collection tube 336. The tube 336 acts as valve operating stem causing downward movement of the nozzle tip 326, thus unseating the tip to permit the flow of liquid downwardly through the passage 318.

It may also be desirable to provide for recovery of air and/or hazardous vapor from the container being filled, especially when the vapor may be harmful to the environment or harmful to personnel conducting the filling operation. In such case, a nozzle hood or bonnet, defining a ventilator housing may be provided as shown at 350 which encloses the upper end of the nozzle and provides an opening 352 with which the nozzle connection 306 is disposed in registry. A set screw 352 provided with a lock nut 354 may be employed to secure the container ventilator housing in properly oriented and spaced relation with the housing structure 302 of the nozzle.

A vacuum tube 356 projects upwardly through an upper wall of the ventilator housing, which tube is in communication with the passage 340 and 332 for the purpose of drip collection. Another vacuum tube 358 having connection with the vacuum tube 356 is disposed in communication with the chamber 360 which is formed by the ventilator housing about the nozzle housing 302.

In use the container ventilator housing is positioned with its lower open end 362 in engagement with the upper surface of a drum or other such container immediately about the filling opening. In this position, the nozzle tube 312 extends downwardly into the container. When the spring 334 is compressed thereby moving the drip collection tube 336 downwardly to open the valve formed by the tip structure 326, fluid is allowed to flow through the supply conduit 310 and passage 308 and downwardly through passage 318 into the container being filled. During filling of the container, air and/or vapor contained within the container will be evacuated by the vacuum applied through the vacuum tube 358 which applies a vacuum within the chamber 360 of the container ventilation housing.

The tip structure 326 at the lower portion of the nozzle defines a sharply diverging tapered surface 364 which directs fluid being dispensed into the container in a downwardly and outwardly diverging flow. This permits high velocity flow of fluid through the passage 318 into the container and, since the flow stream is smooth, minimizes foaming of the fluid being dispensed.

In view of the foregoing, it is evident that the present invention is one well adapted to attain all of the objects and features hereinabove set forth, together with other objects and features which are inherent in the apparatus disclosed herein.

As will be readily apparent to those skilled in the art, the present invention may be produced in other specific forms without departing from its spirit or essential characteristics. The present embodiment, is therefore, to be considered as illustrative and not restrictive, the scope of the invention being indicated by the claims rather than the foregoing description, and all changes which come within the meaning and range of the equivalence of the claims are therefore intended to be embraced therein.

What is claimed is:

1. An apparatus for dripless filling of drum type containers with predetermined volumes of liquid, said drum type containers having a generally planar upper wall surface having a filling opening therein, said apparatus comprising:

(a) a liquid supply housing adapted to receive liquid from a liquid supply and having a seal retainer defining a drip collection vacuum tube opening and a vacuum tube seal about said drip collection vacuum tube opening;

(b) a liquid dispensing tube having a lower end and extending from said liquid supply housing and defining a tapered sealing surface at said lower end thereof, said liquid dispensing tube defining an internal tubular dimension;

(c) a dispensing tip being provided at the lower end of said dispensing tube and having open and closed positions relative to said dispensing tube, said dispensing tip defining upper and lower tapered surfaces and a generally cylindrical external portion of slightly less dimension than said internal tubular dimension and being at least partially located within said dispensing tube at said closed position of said dispensing tip, said lower tapered surface defining a downwardly directed, centrally located point, said dispensing tip further defining an internal drip collection passage terminating at said downwardly directed, centrally located point;

(d) an annular seal member being supported by said dispensing tip and adapted for sealing contact with said tapered sealing surface in the closed position of said dispensing tip;

(e) a drip collection vacuum tube being connected to said dispensing tip and providing support therefor, said drip collection vacuum tube being a valve actuator for positioning of said dispensing tip at said open and closed positions relative to said dispensing tube, said drip collection vacuum tube extending in movable relation through said liquid supply housing and being sealed with respect to said liquid supply housing by said vacuum tube seal; and (f) means urging said drip collection vacuum tube relative to said liquid supply housing in a direction establishing engagement of said annular seal member with said tapered sealing surface, said drip collection vacuum tube being adapted for communication with a source of vacuum.

2. The apparatus for dripless filling of drum type containers with predetermined volumes of liquid of claim 1, including:

(a) a bonnet housing enclosing said liquid supply housing, said bonnet housing having a closed upper end portion and defining a downwardly directed portion having an opening and being oriented for engaging said generally planar upper wall surface surrounding said filling opening of a drum type container being filled;

(b) means for securing said bonnet housing to said liquid supply housing; and (c) means communicating a source of vacuum with said bonnet housing to thus permit vacuum removal of air and vapor being displaced from the drum type container being filled.

3. The apparatus of claim 2, wherein:

(a) said drip collection vacuum tube extending through said bonnet housing; and (b) said means communicating a source of vacuum within said bonnet housing being a bonnet vacuum tube being located externally of said bonnet housing and being connected in vacuum communication with said bonnet housing, said bonnet vacuum tube bring adapted for communications with a source of vacuum.

4. The apparatus of claim 3, wherein:

said drip collection vacuum tube and said bonnet vacuum tube being in vacuum communication with one another.

5. The apparatus of claim 3, wherein:

said bonnet vacuum tube and said drip collection tube each being in fixed connection with said bonnet housing and being interconnected externally of said bonnet housing.

6. The apparatus of claim 1, wherein:

said annular seal member projecting radially outwardly beyond said externally generally cylindrical portion of said dispensing tip and being oriented for sealing engagement with said tapered sealing surface of said liquid dispensing tube.

7. The apparatus of claim 1, wherein:

said annular seal being exposed externally of said dispensing tip and being oriented for sealing engagement with said tapered sealing surface of said liquid dispensing tube.

8. An apparatus for dripless filling of containers with predetermined volumes of liquid, comprising:

(a) a liquid supply housing adapted to receive liquid from a liquid supply and having a closed upper end portion defining a drip collection vacuum tube opening and having a vacuum tube seal about said drip collection vacuum tube opening;

(b) a liquid dispensing tube extending from said liquid supply housing and defining a tapered sealing surface at the lower end thereof, said liquid tube defining an internal tubular dimension;

(c) a dispensing tip being provided at the lower end of said dispensing tube and having open and closed positions relative to said dispensing tube, said dispensing tip defining upper and lower tapered surfaces and a generally cylindrical external portion of slightly less dimension than said internal tubular dimension and being at least partially located within said dispensing tube at said closed position of said dispensing tip, said lower tapered surface defining a downwardly directed, centrally located point, said dispensing tip further defining an internal drip collection passage terminating at said downwardly directed, centrally located point;

(d) an annular seal member being supported by said dispensing tip and adapted for sealing contact with said tapered sealing surface in the closed position of said dispensing tip;

(e) a drip collection vacuum tube being connected to said dispensing tip and providing support therefor, said drip collection vacuum tube being a valve actuator for positioning of said dispensing tip at said open and closed positions relative to said dispensing tube, said drip collection vacuum tube extending in movable relation through said closed upper end portion of said liquid supply housing and being sealed with respect to said liquid supply housing by said vacuum tube seal;

(f) means urging said drip collection vacuum tube relative to said liquid supply housing in a direction establishing engagement of said annular seal member with said tapered sealing surface, said drip collection vacuum tube being adapted for communication with a source of vacuum.

(g) a bonnet housing enclosing said liquid supply housing and defining a downwardly directed portion having an opening and being oriented for engaging the upper wall surface surrounding the filling opening of a drum type container being filled; and (h) means communicating a source of vacuum within said bonnet housing to thus permit vacuum removal of air and vapor being displaced from the drum type container being filled.

9. The apparatus of claim 8, wherein:

said means urging said drip collection vacuum tube being a spring having a pair of spring ends, one of said spring ends being in force transmitting relation with said liquid supply housing and the other of said spring ends being in force transmitting relation with said drip collection vacuum tube.

10. The apparatus of claim 8, wherein:

(a) said drip collection vacuum tube extending through said bonnet housing; and (b) said means communicating a source of vacuum within said bonnet housing being a bonnet vacuum tube being located externally of said bonnet housing and being connected in vacuum communication with said bonnet housing, said bonnet vacuum tube bring adapted for communications with a source of vacuum.

11. The apparatus of claim 10, wherein:

said drip collection vacuum tube and said bonnet vacuum tube being in vacuum communication with one another.

12. The apparatus of claim 10, wherein:

said bonnet vacuum tube and said drip collection tube each being in fixed connection with said bonnet housing and being interconnected externally of said bonnet housing.

* * * * *